US005571664A

United States Patent [19]

Siegel et al.

[11] Patent Number: 5,571,664

[45] Date of Patent: Nov. 5, 1996

[54] COLOR PHOTOGRAPHIC SILVER HALIDE MATERIAL

[75] Inventors: Jörg Siegel, Leverkusen; Peter Hankofer, Köln; Hans-Ulrich Borst, Elsdorf, all of Germany

[73] Assignee: Agfa-Gevaert AG, Germany

[21] Appl. No.: 525,090

[22] Filed: Sep. 8, 1995

[30] Foreign Application Priority Data

Sep. 21, 1994 [DE] Germany ..... 44 33 637.3

[51] Int. Cl.[6] ..... G03C 1/46

[52] U.S. Cl. ..... 430/506; 430/507; 430/511; 430/600; 430/601; 430/603; 430/610; 430/613; 430/614; 430/615

[58] Field of Search ..... 430/506, 507, 430/511, 600, 603, 601, 610, 613, 614, 615

[56] References Cited

U.S. PATENT DOCUMENTS

| | | | |
|---|---|---|---|
| 4,752,560 | 6/1988 | Benard et al. | 430/603 |
| 4,865,965 | 9/1989 | Friour et al. | 430/600 |
| 5,246,828 | 9/1993 | Okuyama et al. | 430/614 |
| 5,393,655 | 2/1995 | Sasaki et al. | 430/611 |

FOREIGN PATENT DOCUMENTS 0521477 1/1993 European Pat. Off. .

OTHER PUBLICATIONS

Technical Photograph Handbook, pp. 522–523, Carona Publishing Co., Ltd., 1987.

*Primary Examiner*—Geraldine Letscher
*Attorney, Agent, or Firm*—Connolly & Hutz

[57] ABSTRACT

A negatively developing color photographic silver halide material containing at least two blue-sensitive, yellow-coupling silver halide emulsion layers, at least two green-sensitive, magenta-coupling silver halide emulsion layers, at least two red-sensitive, cyan-coupling silver halide emulsion layers and a yellow filter layer on a transparent support, the layers of the same spectral sensitivity having different photographic sensitivities and the blue-sensitive layers being arranged further from the support than the yellow filter layer and the green-sensitive and red-sensitive layers being arranged nearer the support than the yellow filter layer, is distinguished by improved development kinetics if at least one of the green-sensitive layers of highest sensitivity and the red-sensitive layers of highest sensitivity contains a crown ether.

13 Claims, No Drawings

COLOR PHOTOGRAPHIC SILVER HALIDE MATERIAL

This invention relates to a negatively developing color photographic silver halide material which contains at least two blue-sensitive, yellow-coupling silver halide emulsion layers, at least two green-sensitive, magenta-coupling silver halide emulsion layers, at least two red-sensitive, cyan-coupling silver halide emulsion layers and a yellow filter layer on a transparent support, the layers of the same spectral sensitivity having different photographic sensitivities and the blue-sensitive layers being arranged further from the support than the yellow filter layer and the green-sensitive and red-sensitive layers being arranged nearer the support than the yellow filter layer, and which is distinguished by improved development kinetics.

The material according to the invention is characterized in that at least one of the green-sensitive layers of highest sensitivity and the red-sensitive layers of highest sensitivity contains an effective quantity of a compound known as a crown ether and the layers of highest sensitivity mentioned contain silver bromide iodide emulsions with a percentage iodide content of 1 to 15 mole-%.

EP 509 810 describes photosensitive silver halide materials characterized by high stability in storage, excellent stability to safety light and high sensitivity. These effects are achieved by the combined use of a red sensitizer and a crown ether referred to as a supersensitizer in photographic materials which comprise a reflective support and a red-sensitive silver halide emulsion layer which is arranged further from the support than the blue-sensitive silver halide emulsion layer. The silver halide emulsions are silver bromide chloride emulsions with high percentage chloride contents. The alleged effects cannot be confirmed for the other silver bromide iodide emulsions mentioned, but not tested.

It has now surprisingly been found that the development kinetics of the material mentioned at the beginning can be improved and, more particularly, a shorter development time than hitherto usual can be achieved providing the red- or green-sensitive layers of highest sensitivity mentioned above contain a crown ether corresponding to one of formulae (I), (II) or (III) below.

The crown ether may be added to the layer at any time before casting. It is preferably added before or during chemical ripening. In a particularly preferred embodiment, it is added to the silver halide emulsion together with the corresponding sensitizer (green- or red-sensitive) before chemical ripening. In this case, small quantities of crown ether are sufficient to achieve the effect according to the invention.

The chemical ripening preferably comprises so-called gold/sulfur (selenium) ripening, i.e. treating the silver halide emulsion with gold compounds on the one hand and sulfur and/or selenium compounds on the other hand at elevated temperature.

The following procedure which comprises four process steps a) to d) has proved successful for the production of chemically and spectrally sensitized photographic silver halide and gelatine emulsions. The process steps in question are:

a) the precipitation of highly disperse, colloid-protected and substantially water-insoluble silver halides by double decomposition between aqueous alkali metal or ammonium halide solutions and aqueous silver or silver diamine nitrate solutions in the presence of gelatine as protective colloid, precipitation optionally being followed by so-called physical ripening to produce required disperse states;

b) removal of the agents remaining in solution during precipitation and physical ripening, such as nitrate ions, alkali metal ions, ammonium ions, by the so-called floc washing process, by the noodle washing process or by ultrafiltration;

c) post-ripening, also known as chemical ripening, in the course of which the emulsions are chemically sensitized by thiosulfates, thiocyanatoaurates (I), thiocyanatopallates (II) added in traces. To this end, the emulsion is digested for 30 to 360 mins. at 36° C. to 60° C. The photosensitivity of the emulsions increases dramatically during the digestion phase. The fog remains low and substantially constant until maximum sensitivity is reached, but then increases more or less considerably. Accordingly, chemical ripening must be terminated immediately after the time $t_{opt}$ which is the time at which the optimal sensitometric data of the emulsions have been achieved. Chemical ripening is terminated by cooling of the emulsion and, optionally, by addition of stabilizers. Stabilized emulsions are stored in cool rooms for a few days to weeks pending their further processing to the photosensitive layers of the photographic image recording materials. Ripening centers are formed on the silver halide microcrystals during chemical ripening and, depending in particular on their dispersity, may advantageously be used as electron donors or electron acceptors in the processes taking place between light absorption and the formation of developable latent image nuclei;

d) addition of sensitizing dyes to the chemically ripened emulsions remelted beforehand and conditioned for casting to photosensitive image recording materials. In this way, the chemically ripened emulsions are also made sensitive to light of those wavelengths which are absorbed by the sensitizing dyes introduced. Now, the efficiency of this spectral sensitization depends critically on whether as many light-energized dye molecules as possible can be reduced and whether the dye radicals formed are able to convert their surplus electrons without losses into developable latent image nuclei.

The crown ethers, which are added to the particular layer in a quantity of $10^{-5}$ to 1 mole/mole of silver bromide iodide, correspond to formulae (I), (II) and (III):

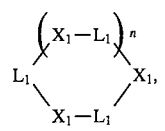

(I)

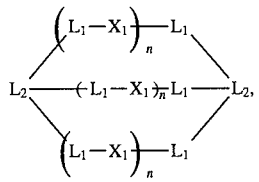

(II)

-continued (III)

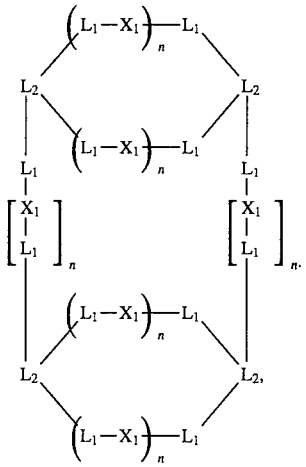

In formulae (I), (II) and (III), the X1's independently of one another represent an element of the 5th or 6th main group of the periodic system of elements, the L1's independently of one another represent an unsubstituted or substituted hydrocarbon radical containing at least two carbon atoms in the main chain, the main chain being the atom sequence between two adjacent atoms $X_1$ or between an atom $X_1$ and an adjacent bridgehead atom $L_2$, the L2's independently of one another represent a bridgehead atom and n is a number of 1 to 10.

Suitable elements $X_1$ are, for example, nitrogen, phosphorus, arsenic, oxygen and sulfur, preferably oxygen.

Hydrocarbon radicals $L_1$ contain 2 to 4 carbon atoms and preferably 2 carbon atoms in the main chain and may be substituted, for example, by alkyl, alkoxy, oxo or carboxy or may be part of a carbocyclic or heterocyclic aromatic ring.

Bridgehead atoms $L_2$ are preferably nitrogen atoms.

Nitrogen, phosphorus and arsenic atoms $L_1$ as third substituents carry in particular hydrogen atoms or phenyl groups or are attached by double bonds to an adjacent group $L_1$, the double bond optionally being part of a fused pyridine ring.

The compounds corresponding to formulae (I), (II) and (III) are known from the literature and are normally referred to as crown ethers, even when the oxygen atoms of the ether groups can be replaced by other elements of the 6th main group or by an element of the 5th main group (see above).

Preferred compounds of formulae (I), (II) and (III) correspond to formulae (IV), (V) and (VI):

(IV)

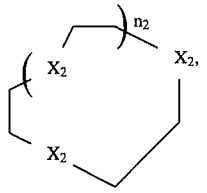

(V)

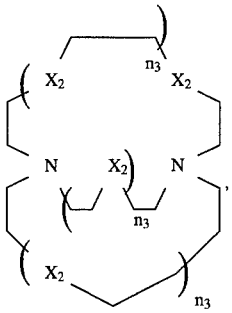

(VI)

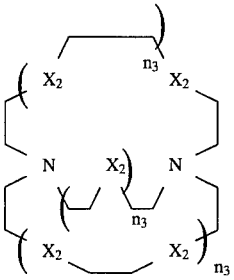

in which the X2's independently of one another represent nitrogen or oxygen, preferably oxygen, and n2 and n3 independently of one another represent a number of 1 to 10 and each corner represents a $—CH_2—$ or —CH— group, two adjacent —CH— groups being part of a fused benzene ring.

The following are suitable compounds of formulae (I) to (VI):

K1

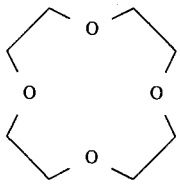

K2

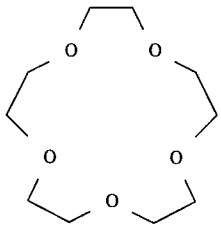

-continued
K3
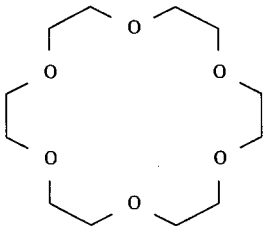
K4
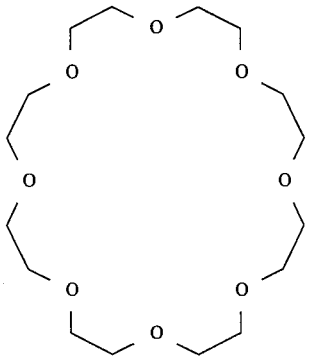
K5
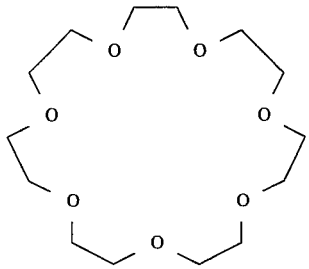
K6
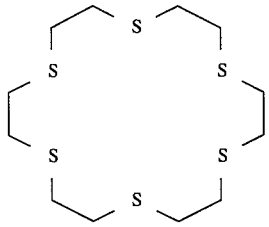
K7
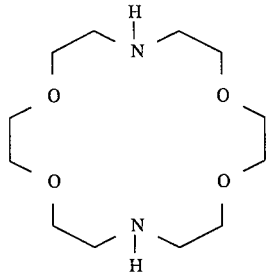
K8
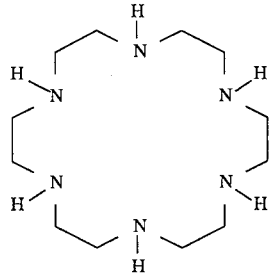

-continued
K9
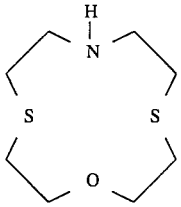
K10
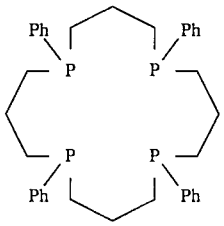
K11
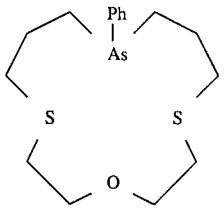
K12
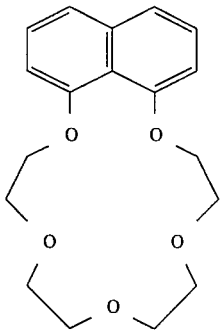
K13
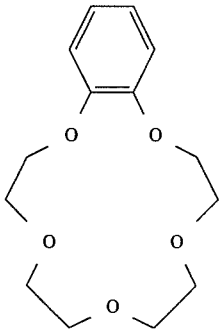

-continued
K14
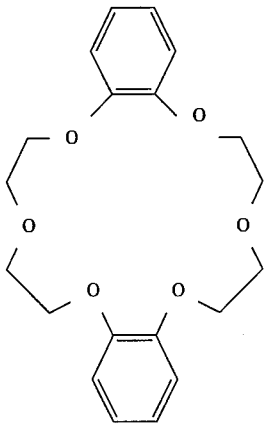
K15
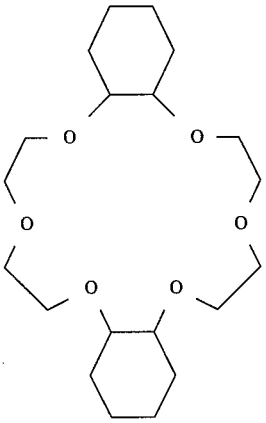
K16
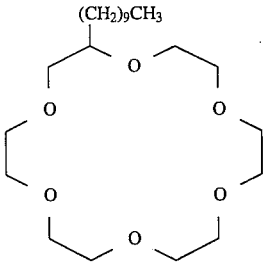
K17
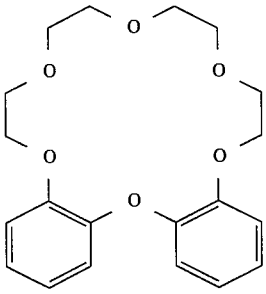

-continued
K18
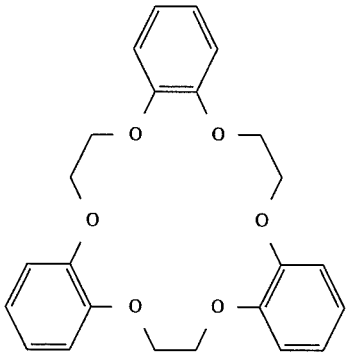
K19
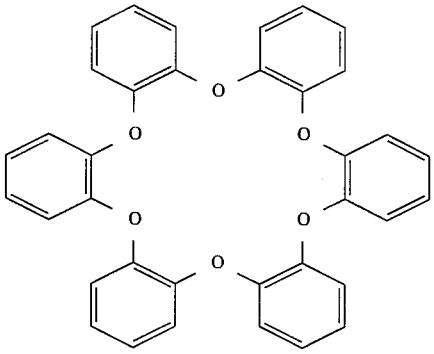
K20
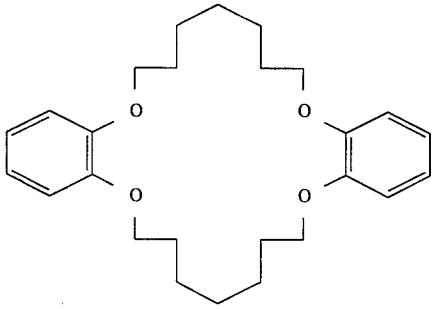
K21
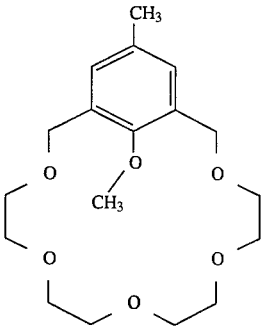

-continued
K22
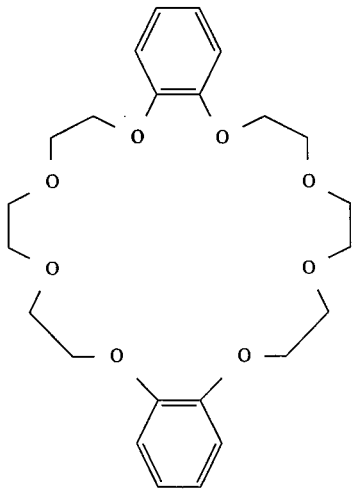
K23
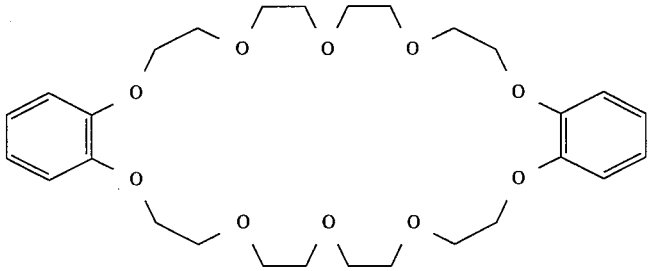
K24
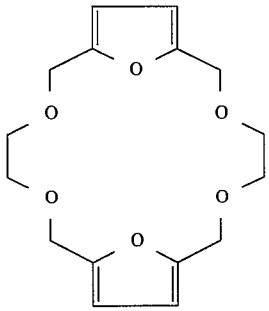
K25
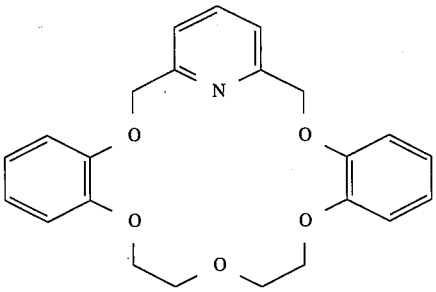
K26
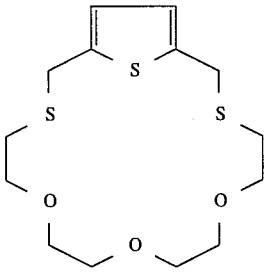

-continued
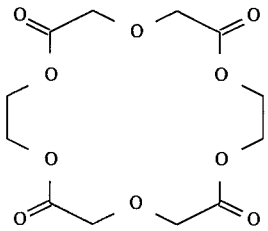
K27
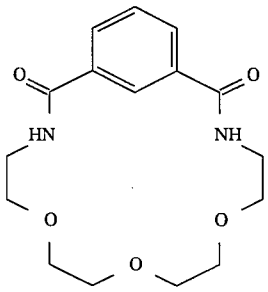
K28
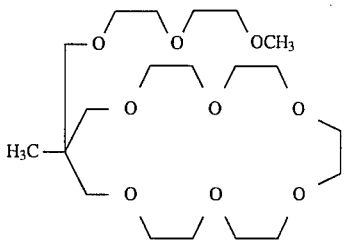
K29
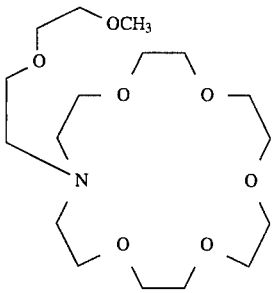
K30
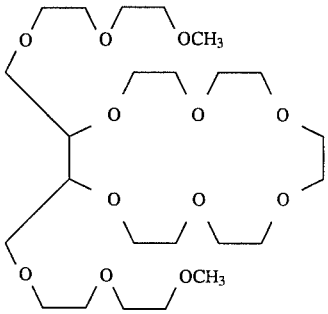
K31

-continued
K32
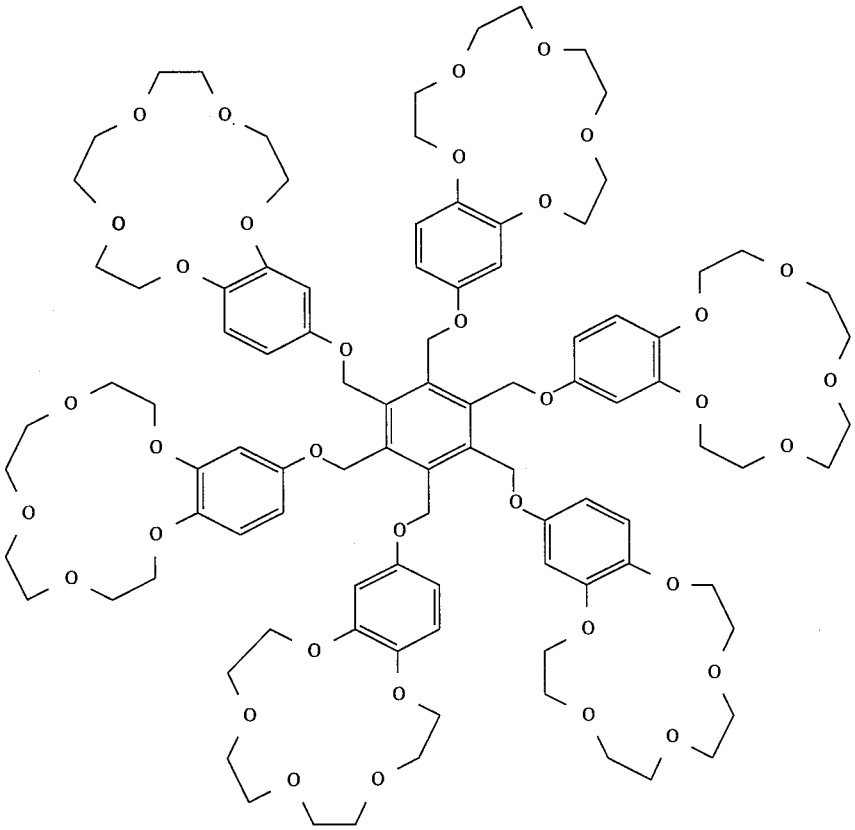
K33
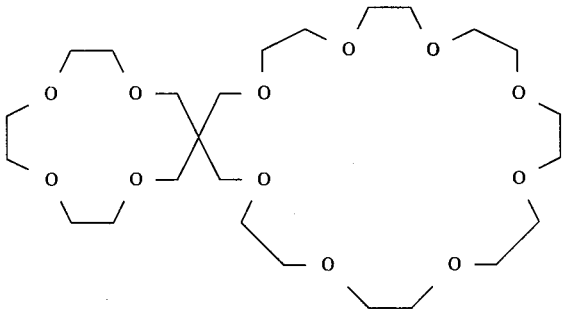
K34
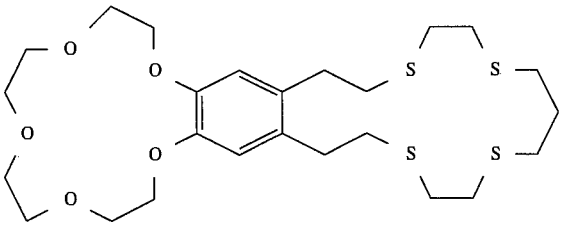
K35
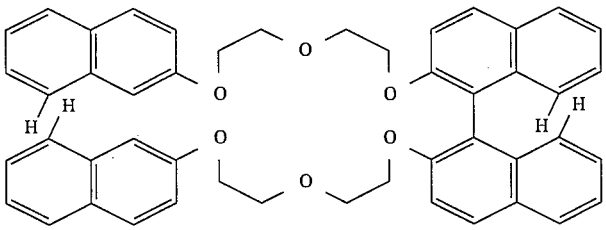

-continued
K36
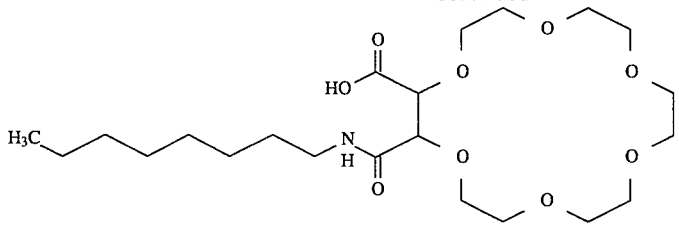
K37
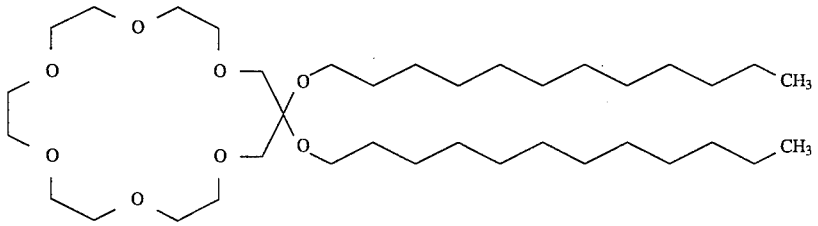
K38
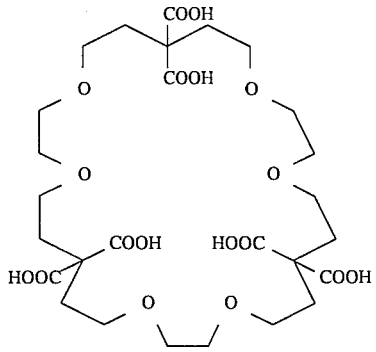
K39
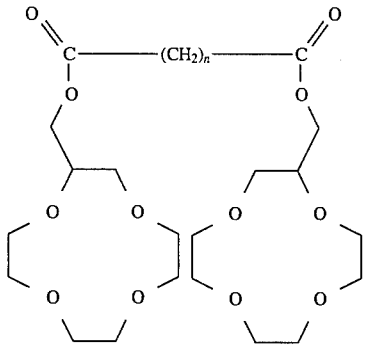
K40
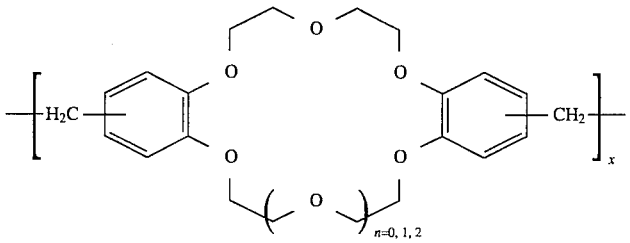

-continued
K41
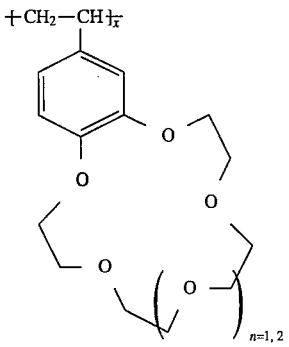
K42
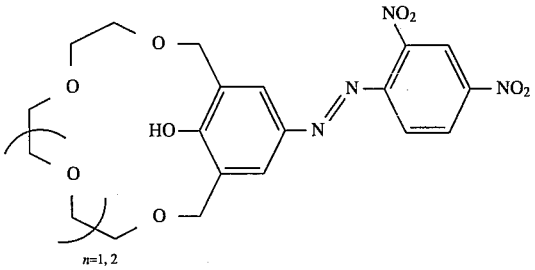
K43
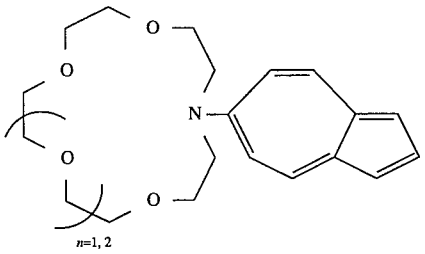
K44
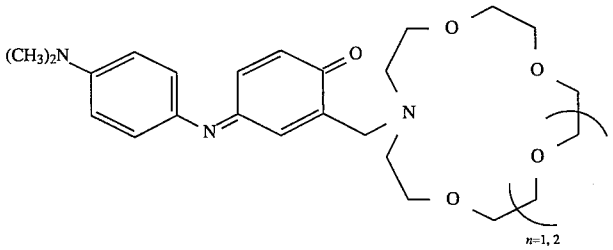
K45
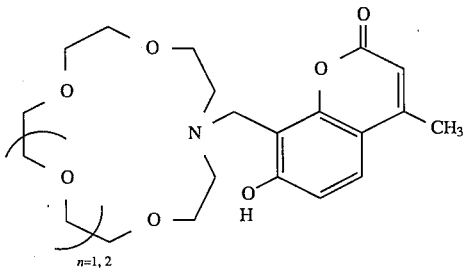
K46
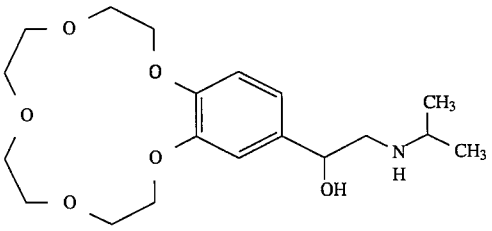

-continued
K47
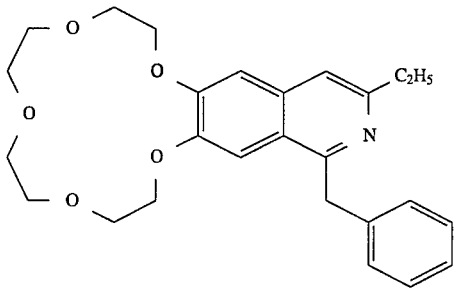
K48
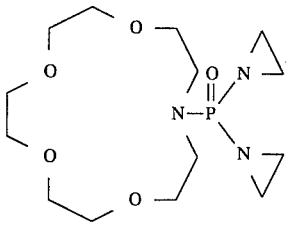
K49
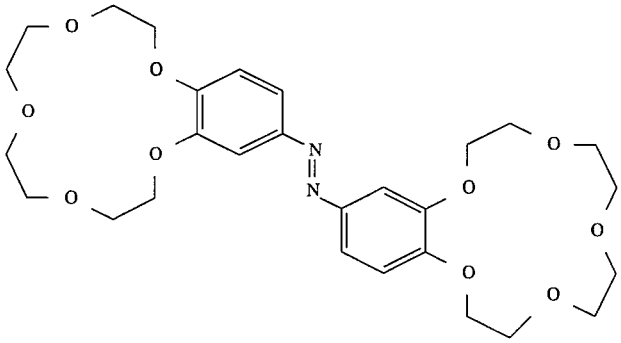
K50
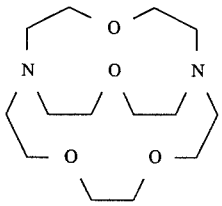
K51
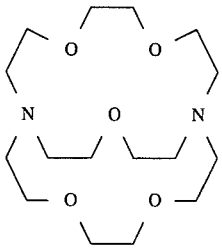
K52
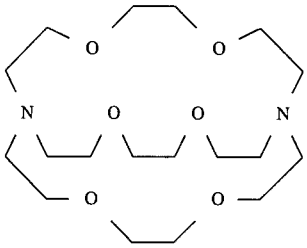

-continued
K53
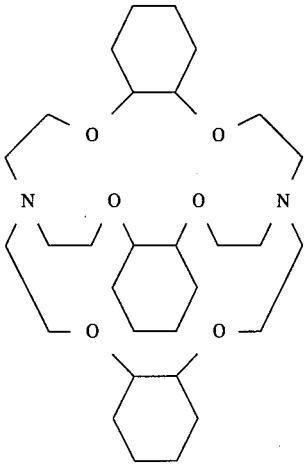
K54
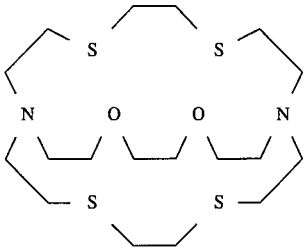
K55
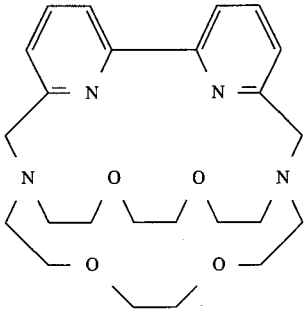
K56
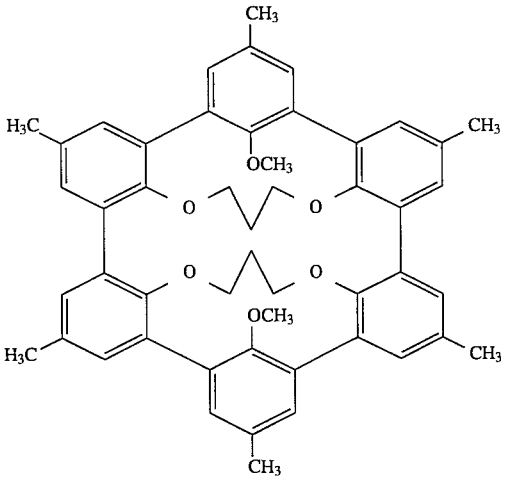

-continued

K57

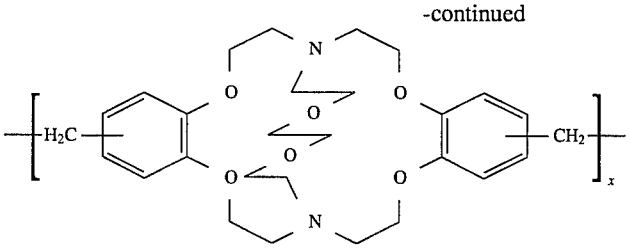

K58

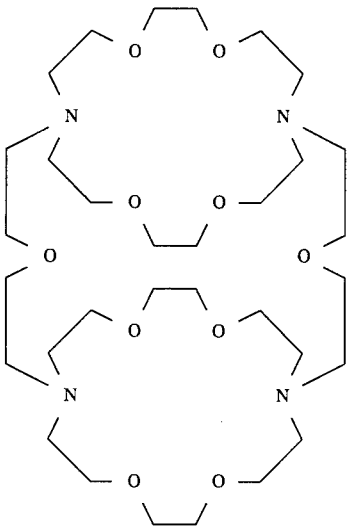

K59

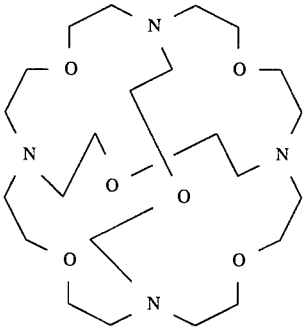

The macrocyclic polyethers mentioned may advantageously be combined with sensitizing dyes which have an oxidation potential of +1.8 to +0.5 V and preferably +1.6 to +0.7 V and of which the exciting energies are from 1.7 to 2.7 eV and preferably from 1.9 to 2.6 eV.

The effective quantity of dye is surprisingly increased by up to 250% of the originally optimal concentration by addition of the polyethers.

The average diameter of the spherical emulsion particles of equal volume is preferably from 0.3 to 2.0 μm and more preferably from 0.5 to 1.5 μm. Tabular hexagonal grains with an aspect ratio of at least 5 which amount to at least 50% of the projected area, particularly 70% of the projected area and with an adjacent edge ratio of from 1:1 to 2:1 are preferred. Monodisperse emulsions with a variation coefficient of less than 30% are particularly preferred.

If the compounds of formulae (I), (II) and (III) are added before or during chemical ripening, they are preferably added to the particular layer in a quantity of $10^{-5}$ to 1 mole/mole of silver bromide iodide.

The use of the compounds corresponding to formulae (I), (II) and (IID is not confined to the red- or green-sensitive layers of highest sensitivity. They may also be used in one or more of the blue-sensitive layers and in layers which are green- or red-sensitized, but which do not have the highest sensitivity. The optimal quantities correspond to the ranges mentioned above, depending on the timing of the addition.

The use of the compounds corresponding to formulae (I), (II) and (III) in the red- or green-sensitive layers of highest sensitivity not only produces an improvement in the development kinetics, it also produces an improved blue-minus blue interval, i.e. an increase in the interval separating sensitivity in the region of the sensitizer sensitivity from the natural sensitivity of the silver bromide iodide emulsion.

The silver halide materials according to the invention are particularly suitable as color photographic recording materials.

Examples of color photographic materials are color negative films, color reversal films and color positive films.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate. They may also be dyed black for the purpose of screening against light. The surface of the support is generally subjected to a treatment to improve the adhesion of the photographic emulsion layer, for example to a corona discharge with subsequent application of a substrate layer.

In addition to the red-, green- and blue-sensitive silver halide emulsion layers and the yellow filter layer, the color photographic materials contain typical interlayers and protective layers.

Key components of the photographic emulsion layers are binders, silver halide crystals and color couplers.

Gelatine is preferably used as binder. However, it may be completely or partly replaced by other synthetic, semisynthetic or even naturally occurring polymers.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The silver halide present as photosensitive constituent in those layers which are not the red- or green-sensitized layers of highest sensitivity may contain as halide chloride, bromide or iodide and mixtures thereof. For example, 0 to 15 mole-% of the halide of at least one layer may consist of iodide, 0 to 20 mole-% of chloride and 65 to 100 mole-% of bromide. Silver bromide iodide emulsions are normally used in the case of color negative and color reversal films. The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 5:1 and more particularly 5:1 to 20:1, the diameter of a crystal being defined as the diameter of a circle with an area corresponding to the projected area of the crystal. Platelet-like silver halide crystals may be present in particular in the layer containing the crown ethers.

The silver halide grains may also have a multiple-layer grain structure, in the most simple case with an inner and an outer core region (core/shell), the halide composition and/or other modifications such as, for example, doping of the individual grain regions, being different. The average grain size of the emulsions is preferably between 0.2 μm and 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al, Making and Coating Photographic Emulsion, The Focal Press, London (1966)).

Precipitation of the silver halide is preferably carried out in the presence of the binder, for example gelatine, in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which new nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

On completion of crystal formation or even at an earlier stage, the soluble salts are removed from the emulsion, for example by noodling and washing, by flocculation and washing, by ultrafiltration or by ion exchangers.

The photographic emulsions may contain compounds to prevent fogging or to stabilize the photographic function during production, storage and photographic processing.

Particularly suitable compounds of this type are azaindenes, preferably tetra- and pentaazaindenes, particularly those substituted by hydroxyl or amino groups. Compounds such as these are described, for example, by Birr, Z. Wiss. Phot. 47 (1952) pages 2 to 58. Other suitable anti-fogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure 17643 (December 1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfur or phosphoric acid esters of an aminoalcohol.

Particularly suitable sensitizing dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643 (December 1978), Chapter IV.

The following dyes (in order of spectral regions) are particularly suitable:

1. as red sensitizers
   9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia- or selenocarbocyanines and 9-ethyl naphthothiaoxa- and benzimidazocarbocyanines, providing the dyes contain at least one sulfoalkyl group at the heterocyclic nitrogen;
2. as green sensitizers
   9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;
3. as blue sensitizers
   symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

The color couplers added to the differently sensitized silver halide emulsion layers are non-diffusing monomeric or polymeric compounds.

In addition, the color photographic material may contain compounds which react with the developer oxidation product and, in doing so, release a photographically active group, for example a development inhibitor, so-called DIR couplers.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. Nos. 2,322,027, 2,801,170, 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A- 28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

The non-photosensitive interlayers generally arranged between layers of different spectral sensitivity may contain agents to prevent unwanted diffusion of developer oxidation products from one photosensitive layer into another photosensitive layer with different spectral sensitization.

Layers of the same spectral sensitization may differ from one another in regard to their composition, particularly so far as the type and quantity of silver halide crystals is concerned. In general, the layer of higher sensitivity is arranged further from tile support than the partial layer of lower sensitivity. Layers of the same spectral sensitization may be arranged adjacent to one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

The layers of the photographic material may be hardened with the usual hardeners.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the multilayer material as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

Color photographic negative materials are normally processed by development, bleaching, fixing and washing or by development, bleaching, fixing and stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methanesulfonamidoethyl)- 3-methyl-p-phenylenediamine, 1-(N-ethyl-N-hydroxyethyl)- 3-methyl-p-phenylenediamine and 1-(N-ethyl-N-methoxyethyl)-3 methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraacetic acid, diethylenetriamine pentaacetic acid, nitrilotriacetic acid, iminodiacetic acid, N-hydroxyethyl ethylenediamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

Color reversal materials are first subjected to development with a black-and-white developer of which the oxidation product is not capable of reacting with the color couplers. This first development is followed by a diffuse second exposure and then by development with a color developer, bleaching and fixing.

In the following Examples, the optimal quantity of gold/sulfur was used for chemical ripening in every case. The sensitivities mentioned were all determined after complete sensitization in the spectral range established by the spectral sensitization ($S_{sens}$=sensitivity in the sensitization maximum; $N_{AgX}$=natural sensitivity of the emulsion; F=fog).

The complementarily colored couplers dissolved in a coupler solvent were added to the emulsions which were then cast onto a transparent layer support of cellulose triacetate.

The samples thus prepared were exposed to red or green light, depending on their sensitization, and processed by the color negative process described in "The British Journal of Photography" 1974, pages 597 and 508. The development times were varied.

EXAMPLE 1

A platy emulsion (88 mole-% AgBr, 12 mole-% AgI) with an average grain size of 1.2 μm and an aspect ratio of 6:1 was used. Tabular hexagonal grains with an adjacent edge ratio of from 1:1 to 2:1 amount to 73% of the projected area; the variation coefficient is 25%.

| | Standard ripening | Ripening in the presence of the dye(s) and/or the compound(s) of formulae (I) to (III) |
|---|---|---|
| Temperature (°C.) | 47 | 47 |
| pH | 6.1 | 6.1 |
| $U_{Ag}$ (mV) | 100 | 100 |
| Quantity of dye before ripening (μmoles/mole Ag) | — | — |
| Compound of one of formulae (I) to (III) before ripening | — | K3 |
| Quantity of compound from the preceding line before ripening (μmoles/mole Ag) | — | 15 |
| Dye after ripening | 1,2,3 | 1,2,3 |
| Quantity of dye after ripening (μmoles/mole Ag) | 90,180,30 | 90,180,30 |
| Compound of one of formulae (I) to (III) after ripening | — | — |
| Quantity of compound from the preceding line (μmoles/mole Ag) | — | — |
| Optimal ripening time (mins.) | 150 | 110 |
| $S_{sens}$ (rel. units), 100 secs. development time | 33.2 | 38.7 |
| F, 100 secs. development time | 0.29 | 0.30 |
| $S_{sens}$ · (rel. units), 195 secs. development time | 41.5 | 43.0 |
| F, 195 secs. development time | 0.29 | 0.31 |
| $S_{sens}$ · (rel. units), 255 secs. development time | 41.9 | 43.2 |
| F, 255 secs. development time | 0.30 | 0.31 |
| $N_{AgX}$ · (rel. units), 195 secs. development time | 36.0 | 36.1 |

EXAMPLE 2

A core shell emulsion (91 mole-% AgBr, 9 mole-% AgI) was used; average grain diameter 1.0 μm, core and shell AgBr with a layer of AgBrI containing 40 mole-% AgI in between.

| | Standard ripening | Ripening in the presence of the dye(s) and/or the compound(s) of formulae (I) to (III) |
|---|---|---|
| Temperature (°C.) | 45 | 45 |
| pH | 6,5 | 6.5 |
| $U_{Ag}$ (mV) | 85 | 85 |
| Dye before ripening | — | 7,8,9 |
| Quantity of dye before ripening (μmoles/mole Ag) | — | 220,100,20 |
| Compound of one of formulae (I) to (III) before ripening | — | K52 |
| Quantity of compound from the preceding line (μmoles/mole Ag) | — | 250 |
| Dye before ripening (μmoles/mole Ag) | 7,8,9 | — |
| Quantity of dye after ripening (μmoles/mole Ag) | 220,100,20 | — |
| Compound of one of formulae (I) to (III) after ripening | — | — |
| Quantity of compound from the preceding line (μmoles/mole Ag) | — | — |
| Optimal ripening time (mins.) | 150 | 110 |
| $S_{sens}$ (rel units), 100 secs. development time | 32.1 | 35.7 |
| F, 100 secs. development time | 0.27 | 0.25 |
| $S_{sens}$ (rel units), 195 secs development time | 40.9 | 42.0 |
| F, 195 secs. development | 0.29 | 0.26 |

-continued

| | Standard ripening | Ripening in the presence of the dye(s) and/or the compound(s) of formulae (I) to (III) |
|---|---|---|
| time | | |
| $S_{sens}$ (rel. units), 255 secs. development time | 41.8 | 42.2 |
| F, 255 secs. development time | 0.30 | 0.28 |
| $N_{AgX}$ (rel. units), 195 secs. development time | 35.1 | 35.2 |

EXAMPLE 3

A platy emulsion (88 mole-% AgBr, 12 mole-% AgI) with an average grain diameter of 1.2 μm and an aspect ratio of 6:1 was used. Tabular hexagonal grains with an adjacent edge ratio of from 1:1 to 2:1 amount to 73% of the projected area; the variation coefficient is 25%.

| | Standard ripening | Ripening in the presence of the dye(s) and/or the compound(s) of formulae (I) to (III) |
|---|---|---|
| Temperature (°C.) | 47 | 47 |
| pH | 6.1 | 6.1 |
| $U_{Ag}$ (mV) | 100 | 100 |
| Dye before ripening | — | 1,2,3 |
| Quantity of dye before ripening (μmoles/ mole Ag) | — | 90,180,30 |
| Compound of one of formulae (I) to (III) before ripening | — | K2 |
| Quantity of compound from the preceding line (μmoles/mole Ag) | — | 110 |
| Dye after ripening | 1,2,3 | — |
| Quantity of dye after ripening (μmoles/ mole Ag) | 90,180,30 | — |
| Compound of one of formulae (I) to (III) after ripening | — | — |
| Quantity of compound from the preceding line (μmoles/mole Ag) | — | — |
| Optimal ripening time (mins.) | 150 | 110 |
| $S_{sens}$ (rel. units), 100 secs. development time | 32.9 | 37.9 |
| F,. 100 secs. development time | 0.28 | 0.30 |
| $S_{sens}$ (rel. units), 195 secs. development time | 41.2 | 42.1 |
| F, 195 secs. development time | 0.29 | 0.31 |
| $S_{sens}$ (rel. units), 255 secs. development time | 41.8 | 42.5 |
| F, 255 secs. development time | 0.29 | 0.31 |
| $N_{AgX}$ (rel. units), 195 secs. development time | 36.0 | 36.1 |

EXAMPLE 4

A core shell emulsion (91 mole-% AgBr, 9 mole-% AgI) was used; average grain diameter 1.0 μm, core and shell AgBr with a layer of AgBrI containing 40 mole-% AgI in between.

| | Standard ripening | Ripening in the presence of the dye(s) and/or the compound(s) of formulae (I) to (III) |
|---|---|---|
| Temperature (°C.) | 45 | 45 |
| pH | 6.5 | 6.5 |
| $U_{Ag}$ (mV) | 85 | 85 |
| Dye before ripening | — | — |
| Quantity of dye before ripening (μmoles/ mole Ag) | | |
| Compound of one of formulae (I) to (III) before ripening | — | — |
| Quantity of compound from the preceding line before ripening (μmoles/ mole Ag) | — | — |
| Dye after ripening | 7,8,9 | 7,8,9 |
| Quantity of dye after ripening (μmoles/ mole Ag) | 220,100,20 | 220,100,20 |
| Compound of one of formulae (I) to (III) after ripening | — | K52 |
| Quantity of compound from the preceding line (μmoles/mole Ag) | — | 1800 |
| Optimal ripening time (mins.) | 150 | 110 |
| $S_{sens}$ (rel. units), 100 secs. development time | 33.3 | 38.9 |
| F, 100 secs. development time | 0.23 | 0.25 |
| $S_{sens}$ (rel. units), 195 secs. development time | 40.6 | 42.3 |
| F, 195 secs. development time | 0.25 | 0.26 |
| $S_{sens}$ (rel. units), 255 secs. development time | 40.9 | 42.4 |
| F, 255 secs. development time | 0.26 | 0.27 |
| $N_{AgX}$ (rel. units), 195 secs. development time | 35.1 | 35.5 |

EXAMPLE 5

A platy emulsion (88 mole-% AgBr, 12 mole-% AgI) with an average grain size of 1.2 μm and an aspect ratio of 6:1 was used. Tabular hexagonal grains with an adjacent edge ratio of from 1:1 to 2:1 amount to 73% of the projected area; the variation coefficient is 25%.

| | Standard ripening | Ripening in the presence of the dye(s) and/or the compound(s) of formulae (I) to (III) |
|---|---|---|
| Temperature (°C.) | 47 | 47 |
| pH | 6.1 | 6.1 |
| $U_{Ag}$ (mV) | 100 | 100 |
| Dye before ripening | — | — |
| Quantity of dye before ripening (μmoles/ mole Ag) | — | — |
| Compound of one of formulae (I) to (III) before ripening | — | — |
| Quantity of compound from the preceding line before ripening (μmoles/ mole Ag) | — | — |
| Dye after ripening | 1,2,3 | 1,2,3 |
| Quantity of dye after ripening (μmoles/ mole Ag) | 90,180,30 | 90,180,30 |

-continued

| | Standard ripening | Ripening in the presence of the dye(s) and/or the compound(s) of formulae (I) to (III) |
|---|---|---|
| Compound of one of formulae (I) to (III) after ripening | — | K31 |
| Quantity of compound from the preceding line (μmoles/mole Ag) | — | 1550 |
| Optimal ripening time (mins.) | 150 | 110 |
| $S_{sens}$ (rel. units), 100 secs. development time | 33.2 | 38.7 |
| F, 100 secs. development time | 0.28 | 0.29 |
| $S_{sens}$ (rel. units), 195 secs. development time | 41.5 | 43.0 |
| F, 195 secs. development time | 0.29 | 0.31 |
| $E_{sens}$ (rel. Einheiten), 255 Sek. Entwicklungszeit | 41, 9 | 43, 2 |
| F, 255 secs. development time | 0.30 | 0.31 |
| $N_{AgX}$ (rel. units), 195 secs. Entwicklungszeit | 36.0 | 36.1 |

EXAMPLE 6

A core shell emulsion (91 mole-% AgBr, 9 mole-% AgI) was used; average grain diameter 1.0 μm, core and shell AgBr with a layer of AgBrI containing 40 mole-% AgI in between.

| | Standard ripening | Ripening in the presence of the dye(s) and/or the compound(s) of formulae (I) to (III) |
|---|---|---|
| Temperature (°C.) | 45 | 45 |
| pH | 6.5 | 6.5 |
| $U_{Ag}$ (mV) | 85 | 85 |
| Dye before ripening | — | — |
| Quantity of dye before ripening (μmoles/mole Ag) | — | — |
| Compound of one of formulae (I) to (III) before ripening | — | K7 |
| Quantity of compound from the preceding line before ripening (μmoles/moles Ag) | — | 450 |
| Dye after ripening | 7,8,9 | 7,8,9 |
| Quantity of dye after ripening (μmoles/mole Ag) | 220,100,20 | 220,100,20 |
| Compound of one of formulae (I) to (III) after ripening | — | — |
| Quantity of compound from the preceding line (μmoles/mole Ag) | — | — |
| Optimal ripening time (mins.) | 150 | 110 |
| $S_{sens}$ (rel. units), 100 secs. development time | 33.5 | 39.4 |
| F, 100 secs. development time | 0.25 | 0.22 |
| $S_{sens}$ (rel. units), 195 secs. development time | 40.9 | 42.0 |
| F, 195 secs. development time | 0.27 | 0.24 |
| $S_{sens}$ (rel. units), 255 secs. development time | 41.1 | 42.4 |

-continued

| | Standard ripening | Ripening in the presence of the dye(s) and/or the compound(s) of formulae (I) to (III) |
|---|---|---|
| F, 255 secs. development time | 0.28 | 0.25 |
| $N_{AgX}$ (rel. units), 195 secs. development time | 35.6 | 35.3 |

EXAMPLE 7

A platy emulsion (88 mole-% AgBr, 12 mole-% AgI) with an average grain size of 1.2 μm and an aspect ratio of 6:1 was used. Tabular hexagonal grains with an adjacent edge ratio of from 1:1 to 2:1 amount to 73% of the projected area; the variation coefficient is 25%.

| | Standard ripening | Ripening in the presence of the dye(s) and/or the compound(s) of formulae (I) to (III) |
|---|---|---|
| Temperature [°C.] | 47 | 47 |
| pH | 6.5 | 6.5 |
| $U_{Ag}$ [mV] | 110 | 110 |
| Dye before ripening | — | 4,5,6 |
| Quantity of dye before ripening (μmoles/mole Ag) | — | 135,270,45 |
| Compound of one of formulae (I) to (III) before ripening | — | K2 |
| Quantity of compound from the preceding line (μmoles/mole Ag) | — | 110 |
| Dye after ripening | 4,5,6 | — |
| Quantity of dye after ripening (μmoles/mole Ag) | 90,180,30 | — |
| Compound of one of formulae (I) to (III) after ripening | — | — |
| Quantity of compound from the preceding line (μmoles/mole Ag) | — | — |
| Optimal ripening time (mins.) | 100 | 80 |
| $S_{sens}$ (rel. units), 100 secs. development time | 33.1 | 38.8 |
| F, 100 secs. development time | 0.34 | 0.29 |
| $S_{secs}$ (rel. units), 195 secs. development time | 41,4 | 43,0 |
| F, 195 secs. development time | 0.35 | 0.30 |
| $S_{sens}$ (rel. units), 255 secs. development time | 42.0 | 43.3 |
| F, development time 255 Sek. | 0.35 | 0.30 |
| $N_{AgX}$ (rel. units), 195 secs. development time | 36.0 | 36.1 |

Formulae of the spectral sensitizers used in the Examples:

1

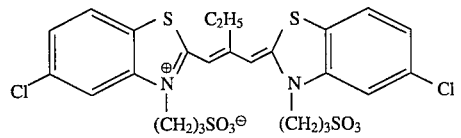

-continued

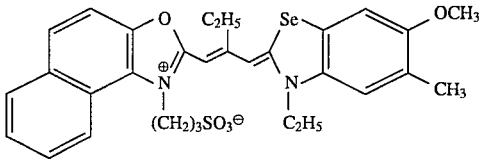

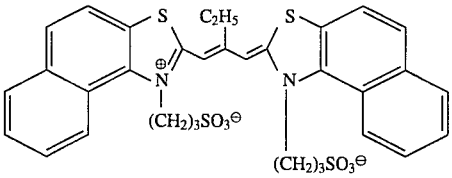

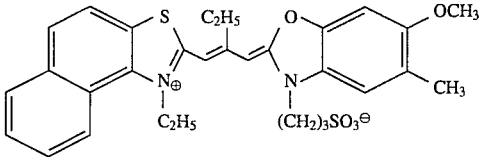

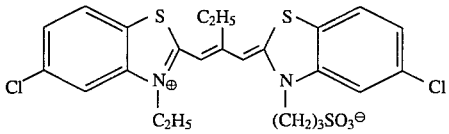

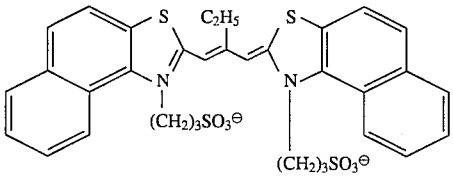

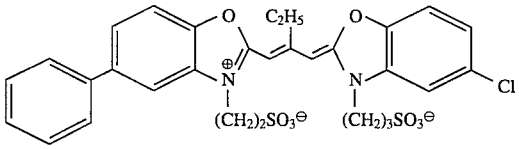

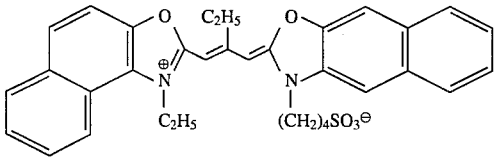

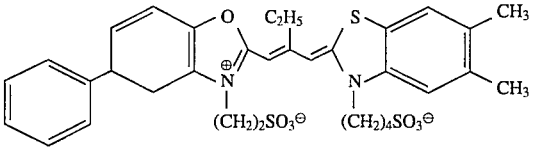

Sensitizers 1 to 6 sensitized for the red region and sensitizers 7 to 9 for the green region.

EXAMPLE 8

A color photographic recording material for color negative color development was prepared by application of the following layers in the order shown to a transparent layer support of cellulose triacetate. All the quantifies shown are based on 1 $m^2$. For the silver halide applied, the corresponding quantifies of $AgNO_3$ are shown. All the silver halide emulsions were stabilized with 0.5 g of 4-hydroxy-6-methyl-1,3,3a,7-tetraazaindene/g $AgNO_3$.

1st Layer (antihalo layer)

0.3 g black colloidal silver
1.2 g gelatine
0.4 g UV absorber UV 1
0.02 g tricresyl phosphate (TCP)

2nd Layer (micrate interlayer)

0.25 g $AgNO_3$ of a micrate Ag(BrI) emulsion, average grain diameter 0.07 μm, 0.5 mole-% iodide
1.0 g gelatine 3rd Layer (low-sensitivity red-sensitive layer)

2.7 g $AgNO_3$ of a spectrally red-sensitized Ag(Br,I) emulsion containing 4 mole-% iodide, average grain diameter 0.5 μm
2.0 g gelatine
0.88 g colorless coupler C1,
0.02 g DIR coupler D1
0.05 g colored coupler RC-1
0.07 g colored coupler YC-1
0.75 g TCP 4th Layer (high-sensitivity red-sensitive layer)

2.2 g $AgNO_3$ of the spectrally red-sensitized Ag(Br,I) emulsion of Example 1 which was ripened in the presence of compound K3,
1.8 g gelatine
0.19 g colorless coupler C2
0.17 g TCP 5th Layer (interlayer)

0.4 g gelatine
0.15 g white coupler W-1
0.06 g aluminium salt of aurin tricarboxylic acid 6th Layer (low sensitivity green-sensitive layer)

1.9 g $AgNO_3$ of a spectrally green-sensitized Ag(Br,I) emulsion, 4 mole-% iodide, average grain diameter 0.35 μm,
1.8 g gelatine
0.54 g colorless coupler M-1
0.24 g DIR coupler D-1
0.065 g colored coupler YM-1
0.6 g TCP 7th Layer (high-sensitivity green-sensitive layer)

1.25 g $AgNO_3$ of a spectrally green-sensitized Ag(Br,I) emulsion, 9 mole-% iodide, average grain diameter 1.0 μm,
1.1 g gelatine
0.195 g colorless coupler M-2
0.05 g colored coupler YM-2
0.245 g TCP 8th Layer (yellow filter layer)

0.09 g yellow colloidal silver
0.25 g gelatine
0.08 g scavenger SC1
0.40 g formaldehyde scavenger FF-1
0.08 g TCP 9th Layer (low-sensitivity blue-sensitive layer)

0.9 g of a spectrally blue-sensitized Ag(Br,I) emulsion, 6 mole-% iodide, average grain diameter 0.6 μm,
2.2 g gelatine
1.1 g colorless coupler Y-1
0.037 g DIR coupler D-1
1.14 g TCP 10th Layer (high-sensitivity blue-sensitive layer)

0.6 g $AgNO_3$ of a spectrally blue-sensitized Ag(Br,I) emulsion, 10 mole-% iodide, average grain diameter 1.2 μm,
0.6 g gelatine
0.2 g colorless coupler Y-1
0.003 g DIR coupler D-1
0.22 g TCP 11th Layer (micrate layer)
0.06 g $AgNO_3$ of a micrate Ag(Br,I) emulsion, average grain diameter 0.06 μm, 0.5 mole-% iodide,
1 g gelatine
0.3 g UV absorber UV-2
0.3 g TCP
12th Layer (protective and hardening layer)
0.25 g gelatine
0.75 g hardener corresponding to the formula:
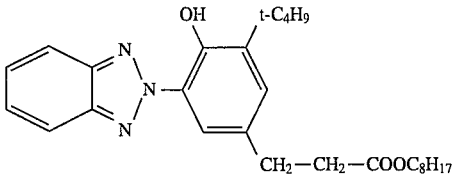
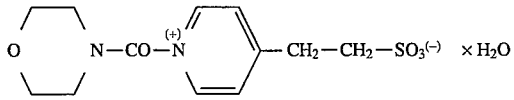
so that the material as a whole had a swelling factor after hardening of ≦3.5.
Substances used in Example 1:
UV-1
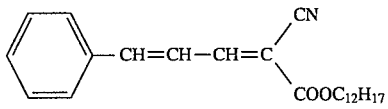
UV-2
C1
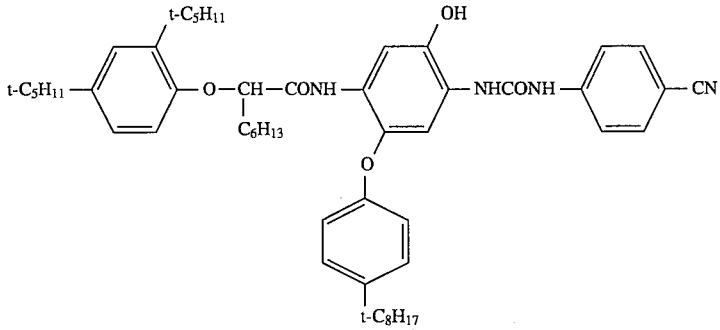
C2
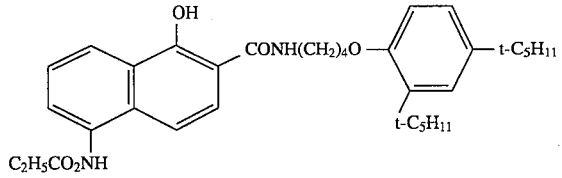
RC-1
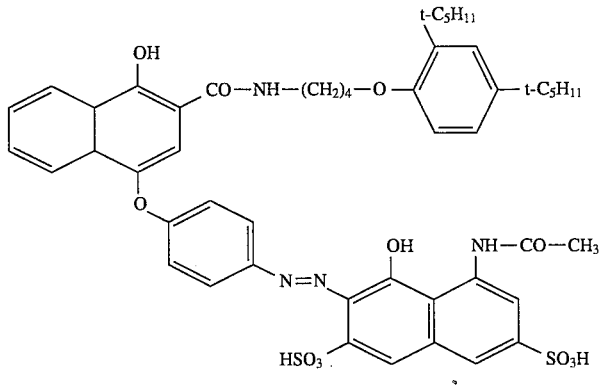

-continued
M-1
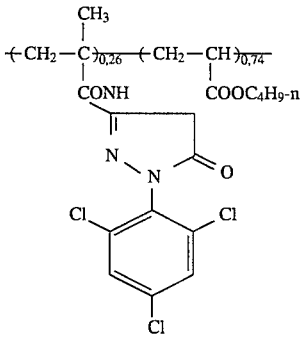
M-2
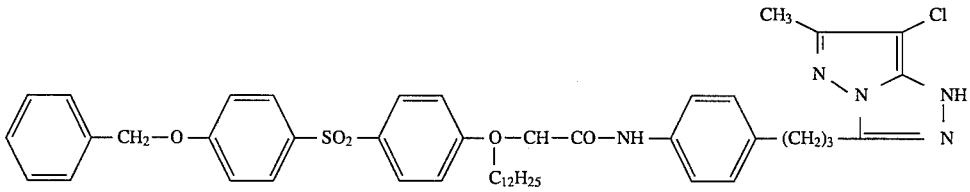
YM-1
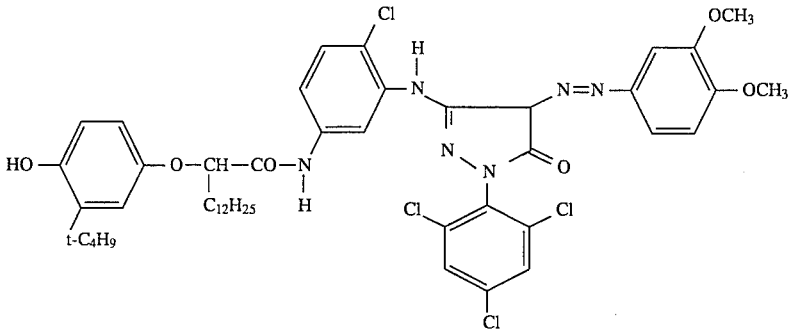
Y1
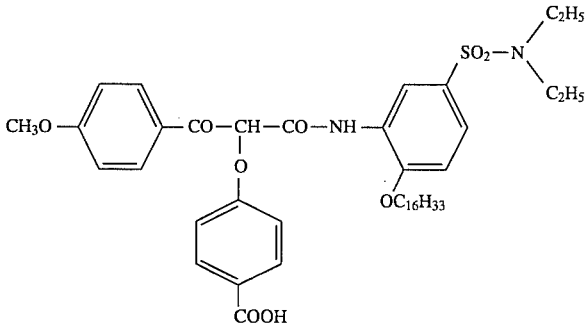
D-1
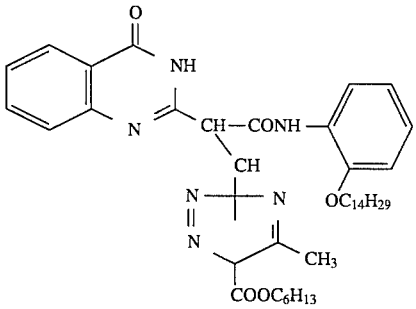

-continued
YC-1
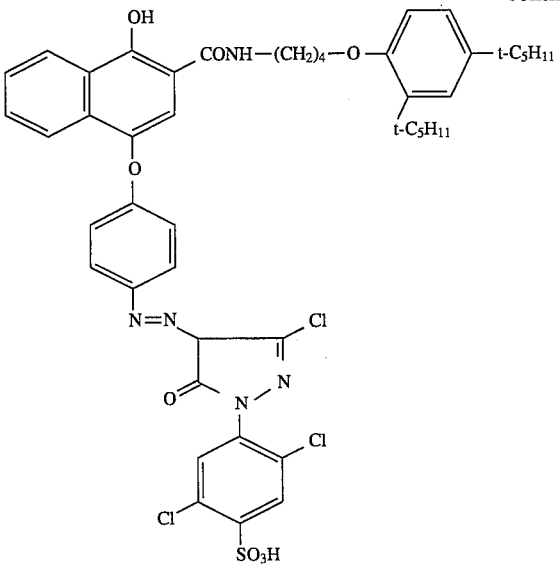
YM-2
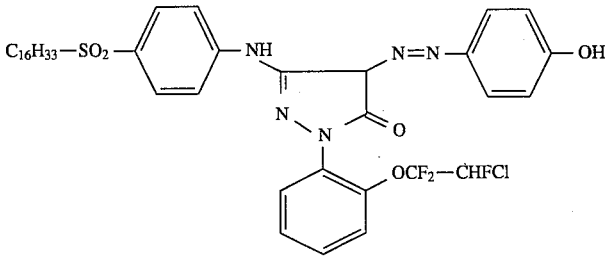
SC-1
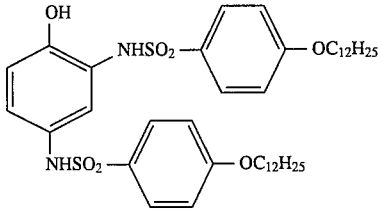
FF-1
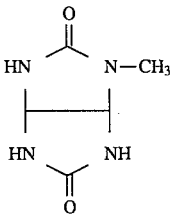
W-1
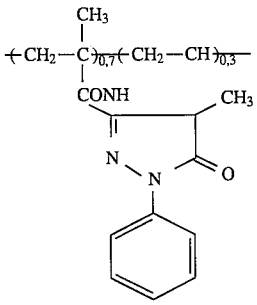
EXAMPLE 9
Example 9 corresponds to Example 8 with the following changes:
The 4th layer contained 2.2 g of a spectrally red-sensitized Ag(Br,I) emulsion containing 12 mole-% of iodide, average grain diameter 1.0 μm.

The 7th layer contained 1.25 g of $AgNO_3$ of the spectrally green-sensitized Ag(Br,I) emulsion of Example 2 which was ripened in the presence of compound K 52.

EXAMPLE 10

Example 10 corresponds to Example 8 with the following changes:

The 7th layer was changed in accordance with Example 9.

We claim:

1. A negatively developing color photographic silver halide material comprising at least two blue-sensitive, yellow-coupling silver halide emulsion layers, at least two green-sensitive, magenta-coupling silver halide emulsion layers, at least two red-sensitive, cyan-coupling silver halide emulsion layers and a yellow filter layer on a transparent support, the layers of the same spectral sensitivity having different photographic sensitivities and the blue-sensitive layers being arranged further from the support than the yellow filter layer and the green-sensitive and red-sensitive layers being arranged nearer the support than the yellow filter layer, wherein at least one of the green-sensitive layers of highest sensitivity and the red-sensitive layers of the highest sensitivity contains a compound corresponding to one of formulae (I), (II) or (III):

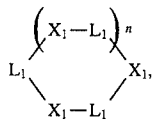
(I)

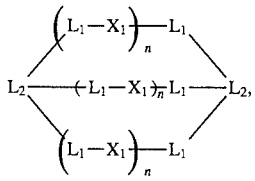
(II)

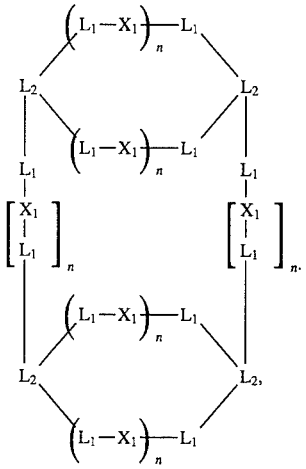
(III)

in which $X_1$ independently of one another represents nitrogen, phosphorus, arsenic, oxygen or sulfur $L_1$ independently of one another represents an unsubstituted or substituted hydrocarbon radical containing at least two carbon atoms in the main chain, the main chain being the atom sequence between two adjacent atoms $X_1$ or between an atom $X_1$ and an adjacent bridgehead atom $L_2$, the substituents of $L_1$ may be part of a carbocyclic or heterocyclic aromatic ring, $L_2$ independently of one another represent a bridgehead atom and n is a number of 1 to 10;

and the layers of highest sensitivity green and red mentioned contain silver bromide iodide emulsions with a percentage iodide content of 1 to 15 mole-%.

2. The color photographic silver halide material as claimed in claim 1, wherein $X_1$ is oxygen, $L_1$ is a hydrocarbon radical containing 2 to 4 carbon atoms in the main chain which may be substituted, $L_2$ is nitrogen.

3. The color photographic silver halide material as claimed in claim 1, wherein the compounds of formula I, II and III correspond to formulae IV, V and VI:

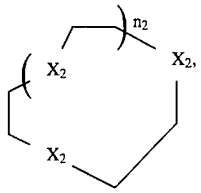
(IV)

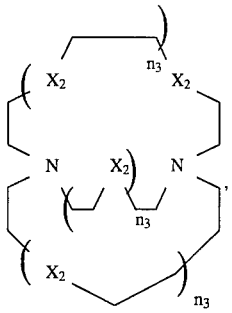
(V)

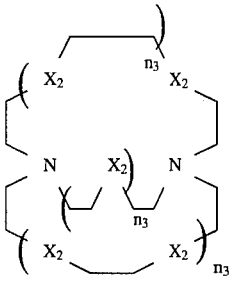
(VI)

in which each of the $X_2$'s independently of one another represent nitrogen or oxygen and $n_2$ and $n_3$ independently of one another represent numbers of 1 to 10 and each comer represents a —$CH_2$— or —CH— group, two adjacent —CH— groups optionally being part of a fused benzene ring.

4. The color photographic silver halide material as claimed in claim 1, wherein the compounds corresponding to formulae (I), (II) or (III) are added before chemical ripening to the silver halide emulsion of the green-sensitive layer of highest sensitivity or the red-sensitive layer of highest sensitivity.

5. The color photographic silver halide material as claimed in claim 1, wherein at least one layer containing one of compounds corresponding to formulae I, II or III contains platelet silver halide crystals with an average diameter to thickness ratio of at least 5:1.

6. The color photographic silver halide material as claimed in claim 5, wherein said platelet silver halide crystals are hexagonal with an aspect ratio of at least 5 amount to at least 50% of the projected area.

7. The color photographic silver halide material as claimed in claim 1, wherein $X_1$ is nitrogen, phosphorus, arsenic, oxygen or sulfur.

8. The color photographic silver halide material as claimed in claim 7, wherein $L_1$ is a hydrocarbon radical containing two carbon atoms in the main chain and optionally, may be substituted with alkyl, alkoxy, or carboxy or, optionally, may be part of a carboxylic or heterocyclic aromatic ring.

9. The color photographic silver halide material as claimed in claim 8, wherein $L_2$ is nitrogen.

10. The color photographic silver halide material as claimed in claim 5, wherein all the $X_2$'s are oxygen.

11. The color photographic silver halide material as claimed in claim 5, wherein said hexagonal platelet silver halide crystals with an aspect ratio of at least 5, amount to 70% of the projected area.

12. The color photographic silver halide material as claimed in claim 6, wherein the hexagonal platelet silver halide crystals have an adjacent edge ratio of from 1:1 to 2:1.

13. The color photographic silver halide material as claimed in claim 11, wherein the hexagonal platelet silver halide crystals have an adjacent edge ratio of from 1:1 to 2:1.

* * * * *